US007775522B2

(12) United States Patent
Tseng

(10) Patent No.: US 7,775,522 B2
(45) Date of Patent: Aug. 17, 2010

(54) AUTOMATIC DICE SHAKING SYSTEM

(76) Inventor: Tzu-Hsiang Tseng, 15/F., No. 367, Hankou Rd., Sec. 4, Taichung City (TW)

( * ) Notice: Subject to any disclaimer, the term of this patent is extended or adjusted under 35 U.S.C. 154(b) by 87 days.

(21) Appl. No.: 12/292,973

(22) Filed: Dec. 2, 2008

(65) Prior Publication Data

US 2010/0133748 A1 Jun. 3, 2010

(51) Int. Cl.
*A63F 9/04* (2006.01)

(52) U.S. Cl. ..... 273/145 C; 273/145 R; 273/145 A; 273/138.2; D21/372; 463/22

(58) Field of Classification Search ..... 273/145 C, 273/145 R, 145 A, 145 CA, 138.2; D21/372; 463/22

See application file for complete search history.

(56) References Cited

U.S. PATENT DOCUMENTS

| | | | | |
|---|---|---|---|---|
| 491,971 | A * | 2/1893 | Williams et al. | 194/276 |
| 1,054,694 | A * | 3/1913 | Langworthy | 273/145 A |
| 3,684,291 | A * | 8/1972 | Johmann | 273/145 R |
| 3,831,948 | A * | 8/1974 | Suda | 273/145 R |
| 4,807,883 | A * | 2/1989 | Silverman | 273/145 C |
| 5,259,618 | A * | 11/1993 | Ramos | 273/145 C |
| 7,185,889 | B2 * | 3/2007 | VanZanten | 273/274 |
| 2007/0090595 | A1 * | 4/2007 | Csikos | 273/149 R |
| 2009/0036187 | A1 * | 2/2009 | Tseng | 463/13 |
| 2009/0264186 | A1 * | 10/2009 | Lai et al. | 463/22 |

OTHER PUBLICATIONS

Taiwan Fulgent Ent. Co., Ltd. RobotCasino, http://www.robotcasino.com.tw, brochure picked up at the Global Gaming Expo, Las Vegas, NV on Sep. 13, 2005.*

* cited by examiner

*Primary Examiner*—Benjamin H Layno
(74) *Attorney, Agent, or Firm*—Rosenberg Klein & Lee

(57) ABSTRACT

An automatic dice shaking system includes multiple dice seat holders each having two locating grooves, multiple dice seats selectively attachable to the dice seat holders, each dice seat having an inner thread and locating rods attachable to the locating grooves of one dice seat holder to prohibit rotation of the respective dice seat relative to the respective dice seat holder, a dice cup connectable to one dice seat by threading an outer thread thereof into the inner thread of one dice seat and movable with the connected dice seat away from the dice seat holders to shake the respective set of dice, and a mechanical arm controllable to move the dice cup horizontally and vertically and to rotate the device cup.

1 Claim, 7 Drawing Sheets

AUTOMATIC DICE SHAKING SYSTEM

BACKGROUND OF THE INVENTION

1. Field of the Invention

The present invention relates to dice game technology and more particularly, to an automatic dice shaking system, which can be controlled to select one of a number of sets of dice and to shake the selected set of dice automatically.

2. Description of the Related Art

Dice are small cubic objects used for generating random numbers for use in tabletop games. In one know dice game, players bet on the banker, and the banker puts the dice in a dice box and shakes the dice. After betting, the banker opens the dice cup and pay the dividens subject to the gambling result. However, performing the dice game in this manner has problems. Because dice shaking and dice cup opening actions are done manually, a dealer may control the points of the dice by means of a manipulation skill or have the expected points to appear by means of the control of the muscular strength of the hand shaking the dice. Therefore, a conventional manual dice shaking operation cannot prevent cheating.

SUMMARY OF THE INVENTION

Therefore, it is desirable to provide an automatic dice shaking system that automatically shakes the dice, avoiding cheating.

To achieve this and other objects of the present invention, the automatic dice shaking system comprises a plurality of dice seat holders arranged on a table top at different locations, each dice seat holder comprising a plurality of locating grooves; a plurality of dice seats selectively attachable to the dice seat holders, each dice seat comprising an inner thread, and a plurality of locating rods attachable to the locating grooves of one dice seat holder to prohibit rotation of the respective dice seat relative to the dice seat holder to which the respective dice seat is attached. Each dice seat holding a respective set of dice; a dice cup connectable to one dice seat and movable with the connected dice seat away from the dice seat holders to shake the respective set of dice, the dice cup comprising an outer thread for threading into the inner thread of one dice seat; and a mechanical arm controllable to move the dice cup horizontally and vertically and to rotate the device cup.

DETAILED DESCRIPTION OF THE PREFERRED EMBODIMENT

Figure 1:
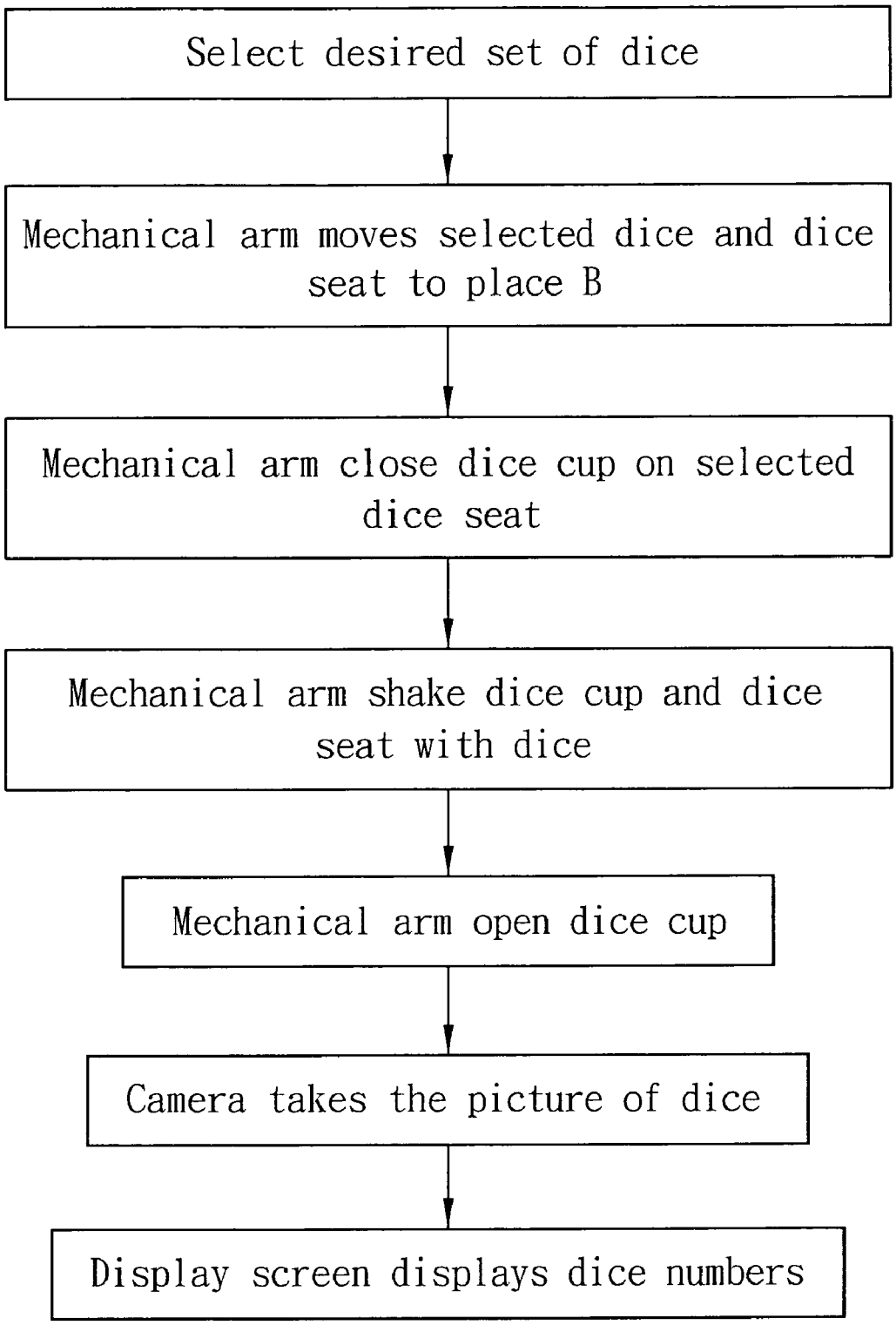
FIG. 1 is an operation flow chart of the present invention.
Figure 2:
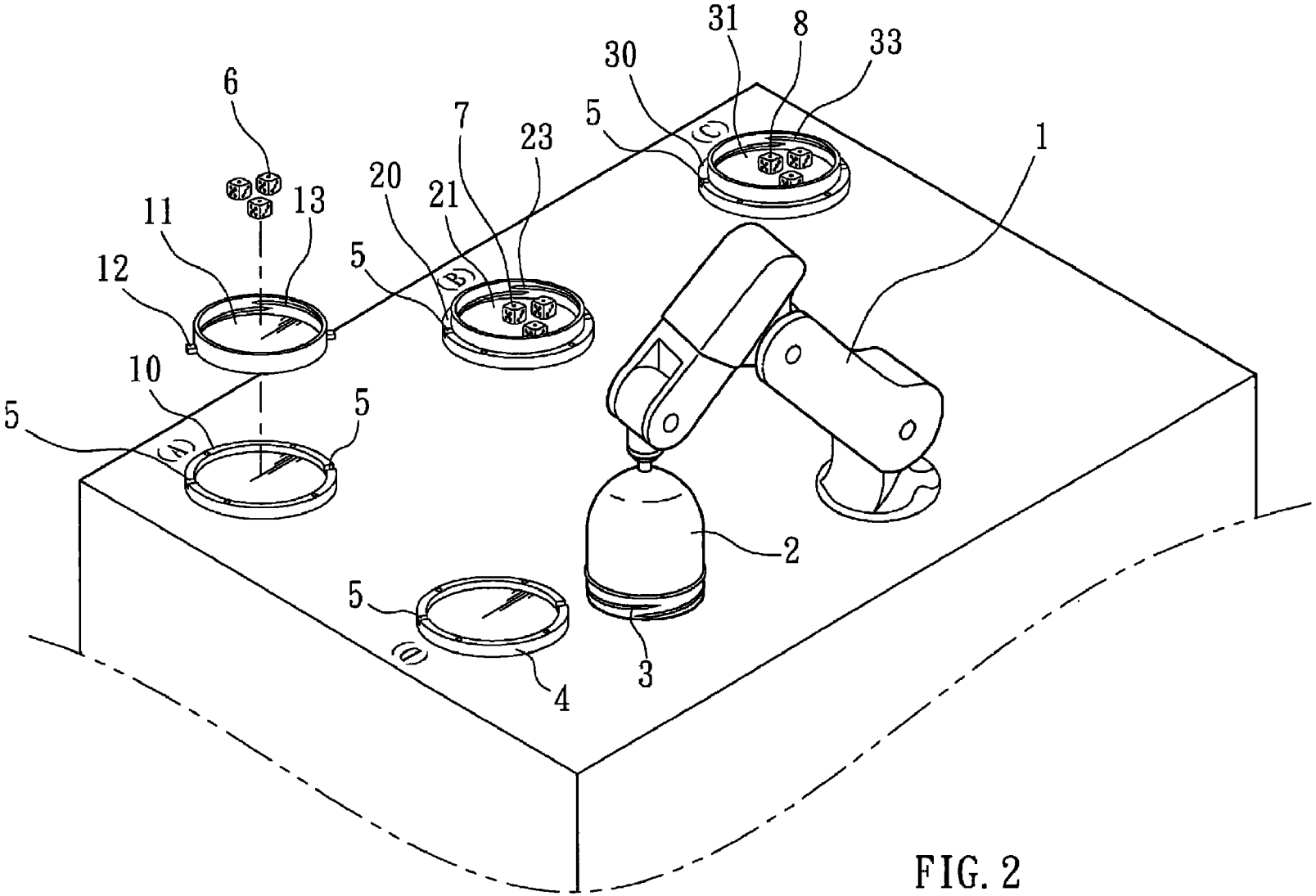
FIG. 2 illustrates an automatic dice shaking system in accordance with the present invention.

Referring to FIGS. 2~6, an automatic dice shaking system in accordance with the present invention is shown mounted on a table, comprising a mechanical arm 1, a first dice seat holder 10, a second dice seat holder 20, a third dice seat holder 30, a fourth dice seat holder 4, a first dice seat 11, a second dice seat 21, and a third dice seat 31. The first through third dice seats 11, 21 and 31 hold a respective set of dice 6, 7 or 8. The mechanical arm 1 has a dice cup 2 coupled to the front end thereof, and controllable to move the dice cup 2 horizontally and vertically and to rotate the dice cup 2. Subject to the operation of the mechanical arm 1, the dice cup 2 can be selectively detachably attached to the dice seat 11, 21 or 31 and moved with the attached dice seat 11, 21 or 31 to shake the respective set of dice 6, 7 or 8.

Figure 3:
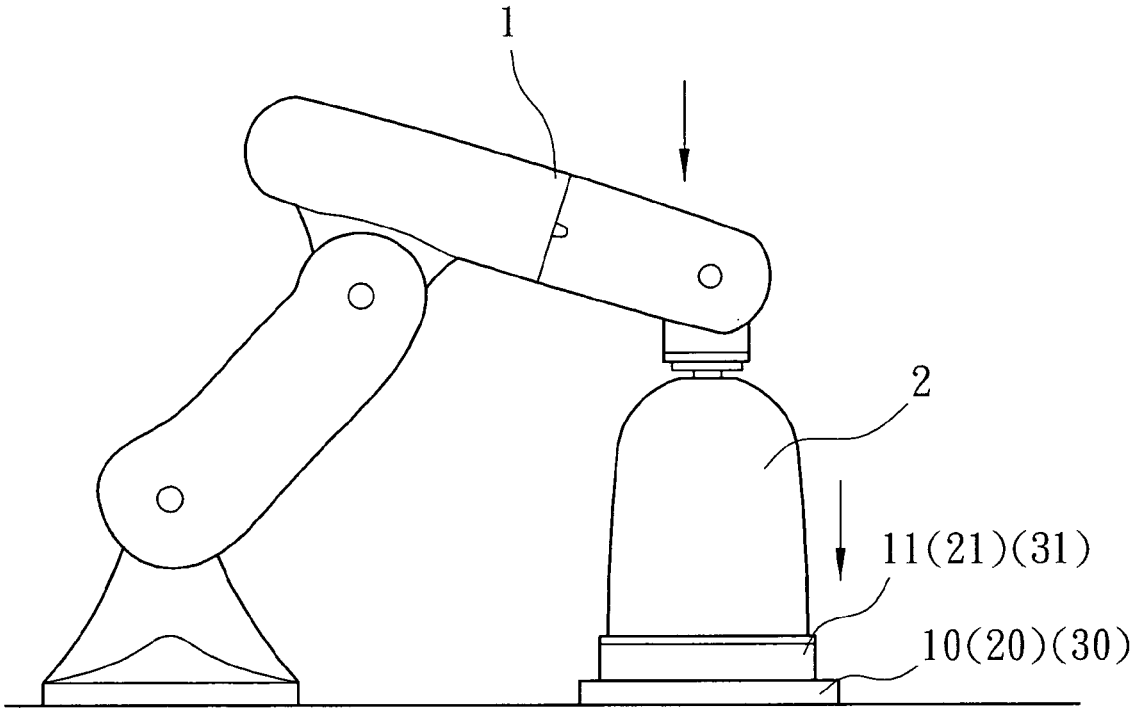
FIG. 3 is a schematic drawing showing the dice cup covered on one dice seat at one dice seat holder according to the present invention.
Figure 4:
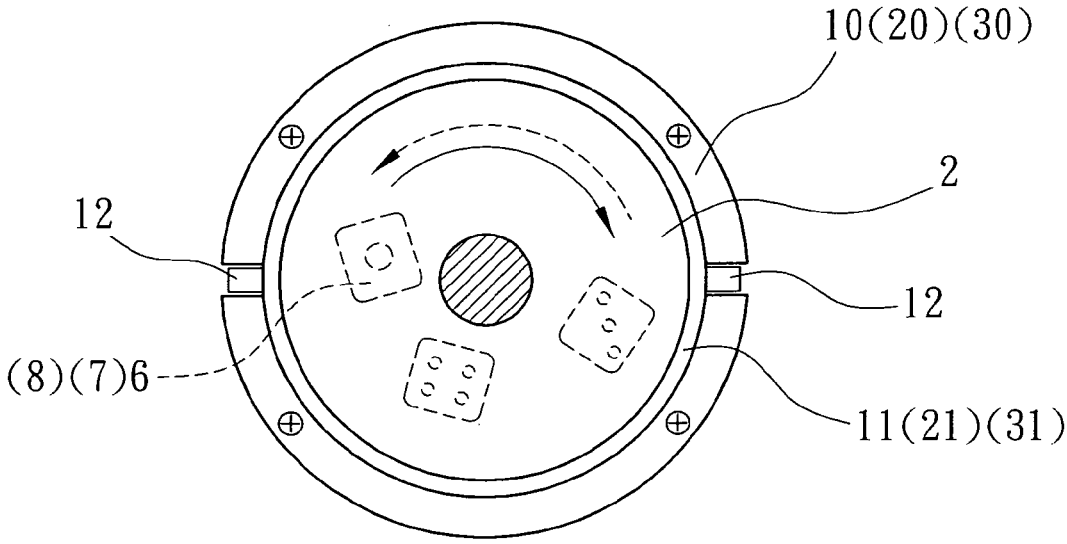
FIG. 4 is a schematic top view of a part of the present invention, showing the dice cup rotated relative to one dice seat at one dice seat holder according to the present invention.

Referring to FIG. 2 again, the dice cup 2 has an outer thread 3 extending around the periphery of the bottom side thereof. Each dice seat 11, 21 or 31 has an inner thread 13, 23 or 33 for engagement with the outer thread 3 of the dice cup 2, and at least one, for example, two locating rods 12 protruded from the periphery at two opposite sides. Each dice seat holder 10, 20, 30 or 4 has at least one, for example, two locating grooves 5 symmetrically disposed at two opposite sides corresponding to the locating rods 12 of each of the dice seats 11, 21 and 31. As shown in FIG. 3, the mechanical arm 1 is controlled to move the dice cup 2 to one dice seat 11, 21 or 31 at the dice seat holder 10, 20 or 30. At this time, the locating rods 12 of the dice seat 11, 21 or 31 are respectively positioned in the locating grooves 5 of the dice seat holder 10, 20 or 30. Thereafter, the mechanical arm 1 is controlled to rotate the dice cup 2, thereby threading the outer thread 3 into the inner thread 13, 23 or 33 of the dice seat 11, 21 or 31. After engagement between the dice cup 2 and the dice seat 11, 21 or 31. The mechanical arm 1 is controlled to life the dice cup 2 and the dice seat the dice seat 11, 21 or 31 from the dice seat holder 10, 20 or 30, and then to rotate the dice cup 2, thereby shaking the dice 6, 7 or 8 on the dice seat 11, 21 or 31. Thereafter, the mechanical arm 1 is controlled to move the dice cup 2 and the connected dice seat 11, 21 or 31 to the dice seat holder 10, 20 or 30, and to rotate the dice cup 2 in the reversed direction, disengaging the dice cup 2 from the dice seat 11, 21 or 31. Thereafter, the mechanical arm 1 is controlled to lift the dice cup 2, and therefore the number of each of the dice 6 is seen.

When playing the game, as shown in FIG. 1, assign one set of the dice 6, 7 or 8 on the dice seat 11, 21 or 31 for playing the game, for example, select the dice 6 on the dice seat 11. As shown in FIGS. 7~12, control the mechanical arm 1 to fasten the dice cup 2 to the second dice seat 21 at place B (see FIG. 7), and then to carry the second dice seat 21 and the respective dice 7 to the fourth dice seat holder 4 at place D (see FIG. 8), and then to move the dice cup 2 to the first dice seat 11 carrying the dice 6 at place A (see FIG. 9), and then to carry the dice cup 2 with the first dice seat 11 and the dice 6 to the second dice seat holder 20 at place B (see FIG. 10), and then to move the dice cup 2 to the dice cup 2 to second dice seat 21 at place D (see FIG. 11) and to fasten the dice cup 2 to the second dice seat 21, and then to carry the dice cup 2 with the second dice seat 21 and the respective dice 7 to the first dice seat holder 10 at place A (see FIG. 10), finishing shift of the first set of dice 6 to place B. In the same manner, the third dice seat 31 with the third set of dice 8 can be shifted from place C to place B.

Figure 5:
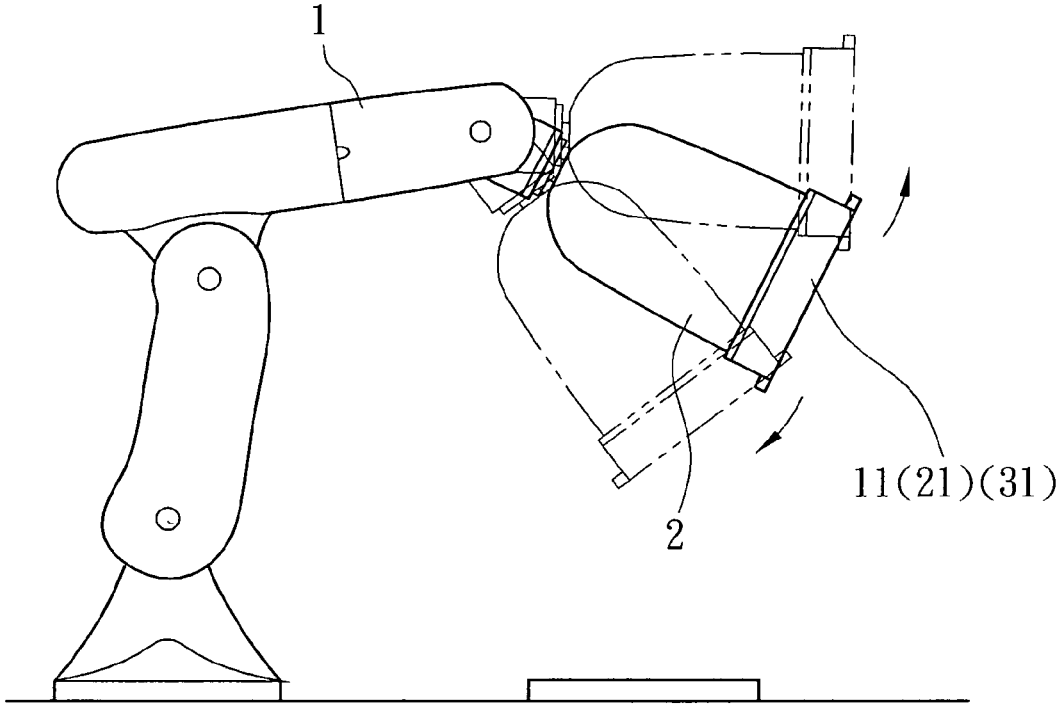
FIG. 5 is a schematic drawing showing a dice shaking action of the automatic dice shaking system in accordance with the present invention.
Figure 6:
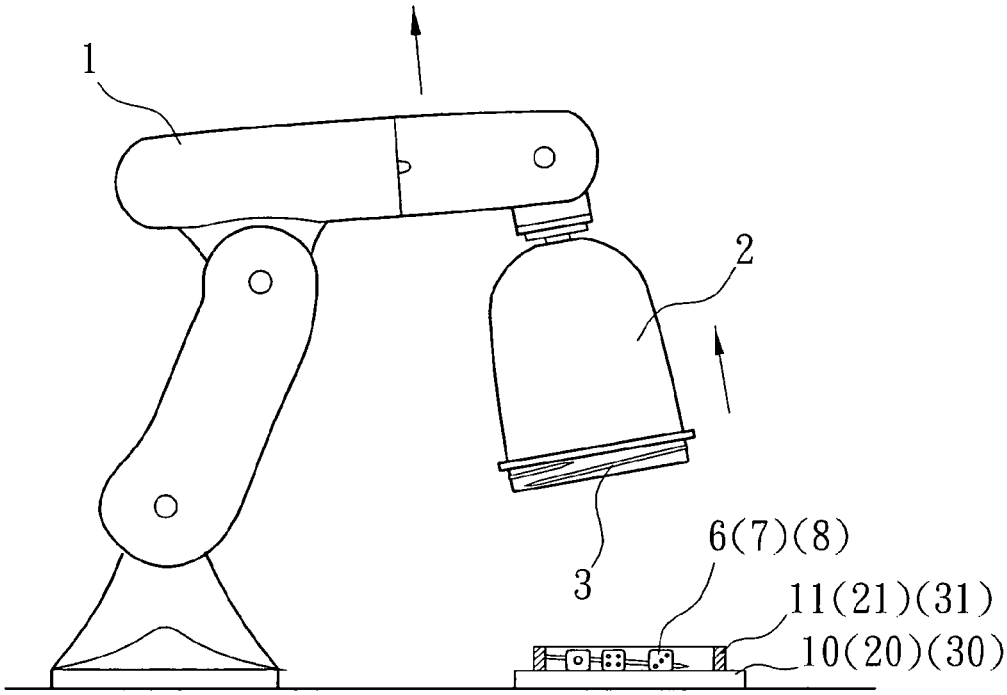
FIG. 6 is a schematic drawing showing a dice cup opened from the dice seat according to the present invention.
Figure 7:
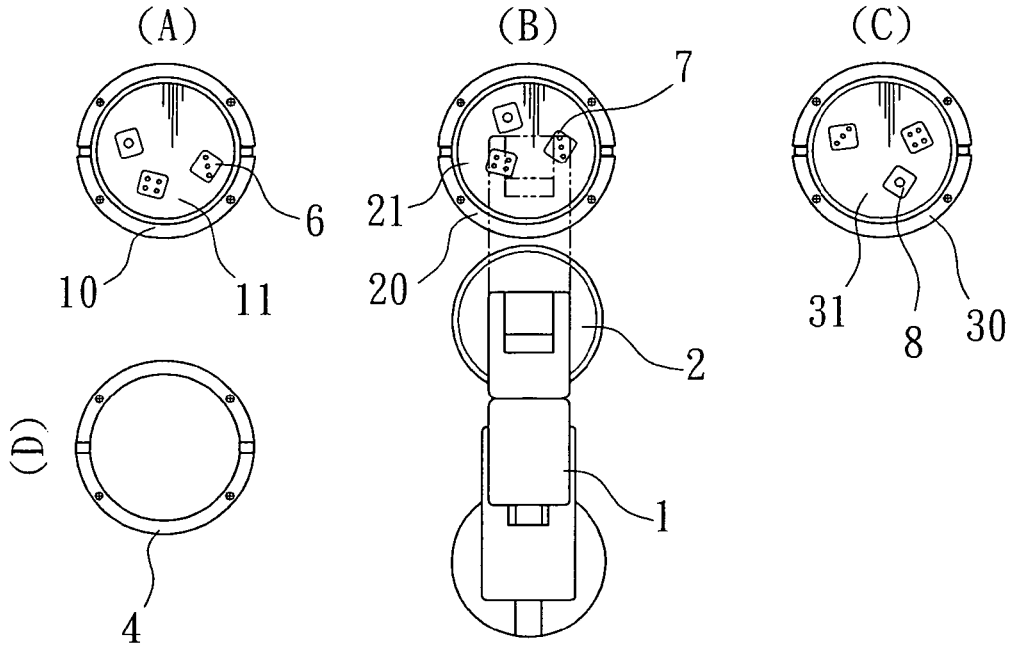
FIG. 7 is a schematic drawing of the present invention, showing the second set of dice selected.
Figure 8:
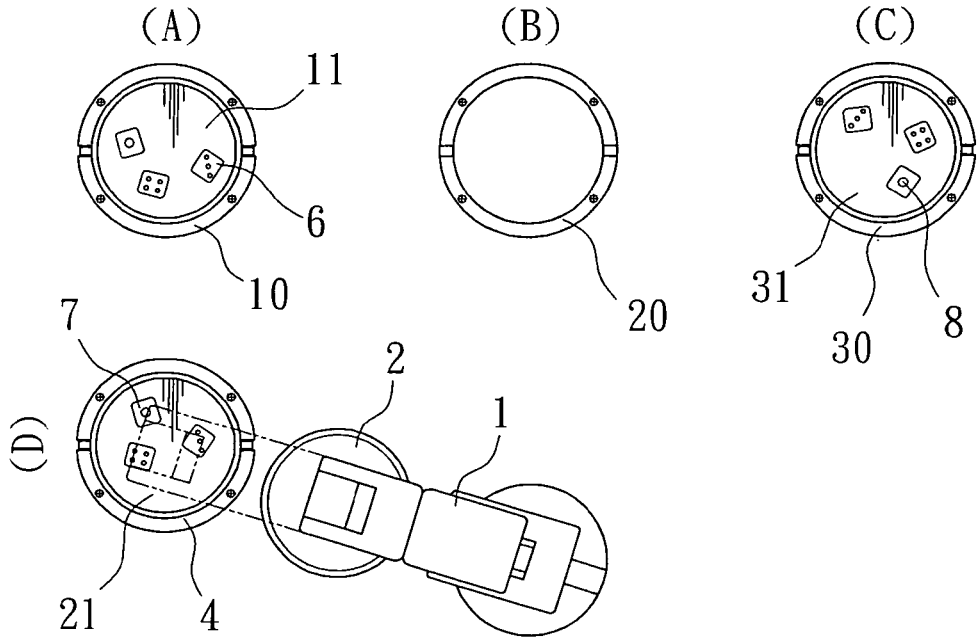
FIG. 8 is a schematic drawing of the present invention, showing the second set of dice shifted to place D.
Figure 9:
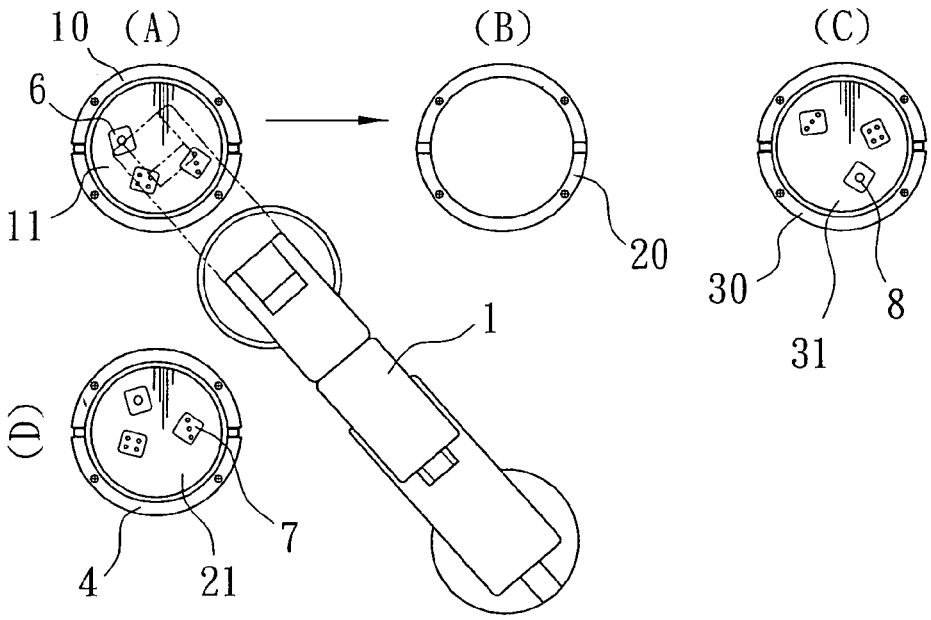
FIG. 9 is a schematic drawing of the present invention, showing the first set of dice at place A selected.
Figure 10:
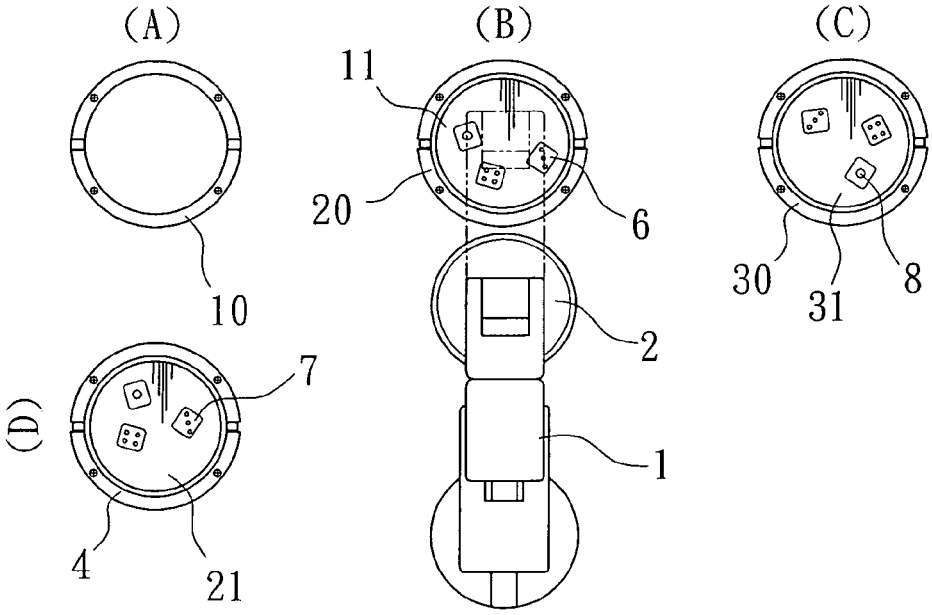
FIG. 10 is a schematic drawing of the present invention, showing the first set of dice shifted to place B.
Figure 11:
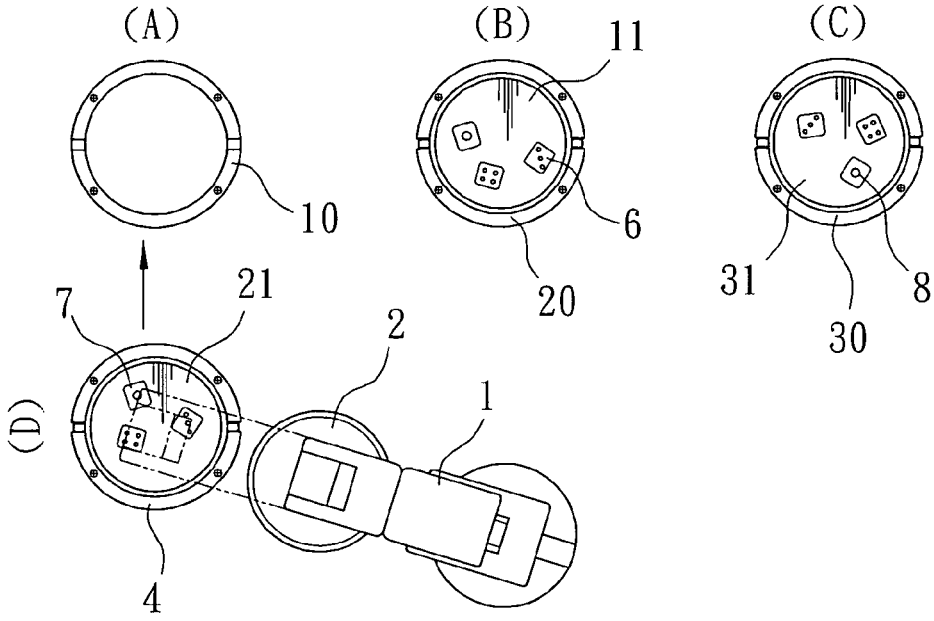
FIG. 11 is a schematic drawing of the present invention, showing the mechanical arm moved to the second set of dice at place D.
Figure 12:
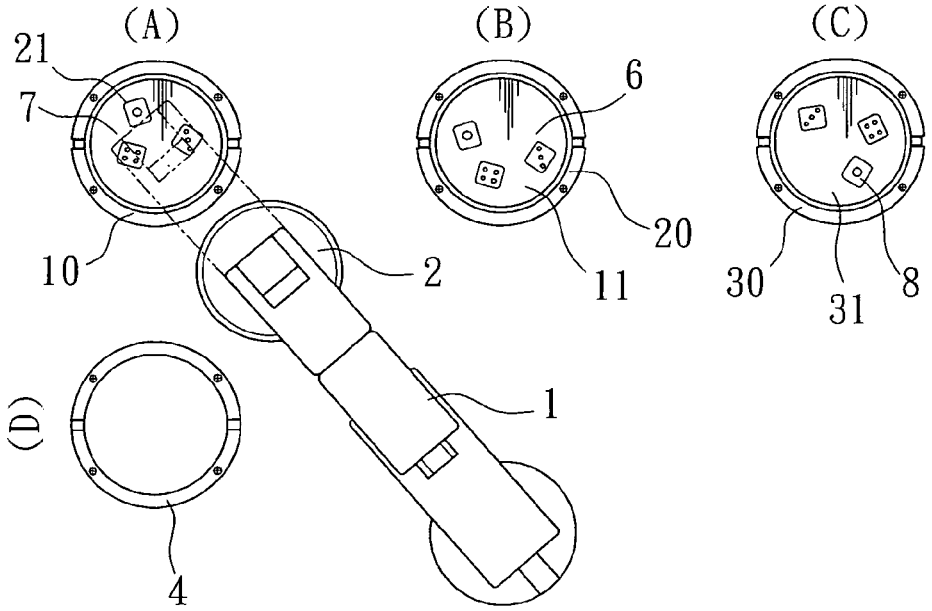
FIG. 12 is a schematic drawing of the present invention, showing the second set of dice shifted to place A.

After shifting of the dice 6, 7 or 8 to place B, the mechanical arm 1 is controlled to fasten the dice cup 2 to the first dice seat 11 (see FIGS. 3 and 4), and then to move the dice cup 2 and the first dice seat 11, thereby shaking the dice 6 (see FIG. 5). Thereafter, the mechanical arm 1 is controlled to open the dice cup 1 from the first dice seat 11 (see the imaginary line in FIG. 4), and therefore the numbers of the dice 6 are seen. A digital camera (not shown) is controlled to take the picture of the dice 6, enabling a display screen (not shown) to display the numbers of the dice 6.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An automatic dice shaking system, comprising:

a plurality of dice seat holders arranged on a tabletop at different locations, each said dice seat holder comprising a plurality of locating grooves;

a plurality of dice seats selectively attachable to said dice seat holders, each said dice seat comprising an inner thread, and a plurality of locating rods attachable to the locating grooves of one said dice seat holder to prohibit rotation of the respective dice seat relative to the dice seat holder to which the respective dice seat is attached, each said dice seat holding a respective set of dice;

a dice cup connectable to one said dice seat and movable with the connected dice seat away from said dice seat holders to shake the respective set of dice, said dice cup comprising an outer thread for threading into the inner thread of one said dice seat; and a mechanical arm controllable to move said dice cup and connected dice seat horizontally and vertically and to rotate said dice cup and connected dice seat.

* * * * *